US007419320B2

(12) United States Patent
LaBrasca

(10) Patent No.: US 7,419,320 B2
(45) Date of Patent: Sep. 2, 2008

(54) MARKER PEN STORAGE SYSTEM

(76) Inventor: Claude LaBrasca, 951 NE. 4th Ave., Boca Raton, FL (US) 33432

( * ) Notice: Subject to any disclaimer, the term of this patent is extended or adjusted under 35 U.S.C. 154(b) by 125 days.

(21) Appl. No.: 11/525,180

(22) Filed: Sep. 22, 2006

(65) Prior Publication Data

US 2008/0085143 A1 Apr. 10, 2008

(51) Int. Cl.

| | |
|---|---|
| ***B43K 23/02*** | (2006.01) |
| ***A45C 11/34*** | (2006.01) |
| ***B65D 85/20*** | (2006.01) |
| ***B65D 1/24*** | (2006.01) |
| ***B05C 17/00*** | (2006.01) |
| ***A47F 7/00*** | (2006.01) |

(52) U.S. Cl. ..... 401/131; 206/214; 206/443; 206/1.7; 211/69.1; 220/513

(58) Field of Classification Search ..... 401/131, 401/52, 195, 199; 206/214, 224, 443, 1.7, 206/371, 804, 815, 418, 419, 420, 421; 211/69.1, 211/69.5; 220/500, 507, 513, 555
See application file for complete search history.

(56) References Cited

U.S. PATENT DOCUMENTS

| | | | | |
|---|---|---|---|---|
| 3,315,644 | A | 4/1967 | Riepe | |
| 4,155,446 | A | 5/1979 | Aronson | |
| 4,349,109 | A * | 9/1982 | Scordato et al. | 206/562 |
| 4,415,092 | A * | 11/1983 | Boyer | 211/69.1 |
| 4,538,736 | A | 9/1985 | Berger | |
| 4,562,923 | A | 1/1986 | Katada et al. | |
| 4,666,043 | A | 5/1987 | Tahara | |
| 4,798,310 | A | 1/1989 | Kasai et al. | |
| 4,826,338 | A | 5/1989 | Kilpatrick | |
| 5,033,629 | A * | 7/1991 | Caine | 211/69.5 |
| 5,163,549 | A | 11/1992 | Hayduchok | |

(Continued)

*Primary Examiner*—David Walczak
*Assistant Examiner*—Michael Barca
(74) *Attorney, Agent, or Firm*—McGuireWoods LLP

(57) ABSTRACT

A marker pen storage system comprising a housing having a plurality of receptacles for receiving marker pens, each receptacle formed to include an upper and lower cavity, the upper cavity located at the opening of the receptacle and formed to include a first upper inclined section and a first lower inclined section, wherein the first upper inclined section has a greater incline than the first lower inclined section, said lower cavity sized to receive a writing end of a marker pen, receptacle openings are formed immediately adjacent so as to create guidance walls between each receptacle, and prevent a flat upper surface from being formed between adjacent receptacles, and a snap ring formed between the upper and lower cavities, wherein a relatively airtight seal is formed around the writing end of a marking pen when it is completely inserted into the lower cavity so as to prevent circulation of air to the writing end of an inserted marking pen, and the snap ring produces a snap feel and sound when a marker pen is completely inserted into the lower cavity. Guidance walls between the receptacles enables a user to properly insert a marker pen without having a direct line of site to the proper receptacle, thereby making the marker pen holder very easy for young children to use and put away the marker when it is time to clean up. Also, the snap ring prevents markers from spilling out of the holder, which is very useful when marker pens are carried in children's backpacks to and from school or the like.

20 Claims, 6 Drawing Sheets

U.S. PATENT DOCUMENTS 5,263,602 A * 11/1993 Lathouris ..... 220/23.83
5,332,090 A 7/1994 Tucker
5,372,252 A 12/1994 Alexander
5,441,149 A * 8/1995 Willard et al. ..... 206/214
5,628,400 A 5/1997 Feder
5,823,363 A 10/1998 Cassel
6,022,159 A 2/2000 Kossnar et al.
6,186,461 B1 2/2001 Pelaez
6,202,862 B1 * 3/2001 Acquaviva et al. ..... 211/69.5
6,257,539 B1 7/2001 Pelaez
6,269,960 B1 8/2001 Harp
D492,720 S 7/2004 Chiu
6,871,767 B2 3/2005 Perlman et al.
6,974,026 B2 12/2005 Chan et al.
7,314,142 B2 * 1/2008 Lyman, Jr. ..... 211/69.5
D562,557 S * 2/2008 Lewis ..... D3/313

* cited by examiner

MARKER PEN STORAGE SYSTEM

FIELD OF THE INVENTION

The present invention pertains specifically to storage of ink writing and drawing markers, and more particularly, to felt tip ink markers stored in a cardboard box or similar package.

BACKGROUND OF THE INVENTION

Conventional storage containers for drawing markers are generally cardboard or plastic boxes with no organizational or other guidance structures inside, similar to crayon boxes. Marker pen boxes offer a user no assistance with placing the markers back into the storage box properly or neatly. Common household issues, especially with young children, include markers being left out open without a top or cap placed back onto the marker to prevent drying out.

Additionally, even with the conventional cap and storage systems for drawing markers, the caps themselves are considered a choking hazard for small children whom represent a predominant user group of markers. The choking hazard created by conventional marker cap systems create a dilemma for parents, guardians, daycare centers, schools, where children of various ages are mixed together, including children too young to appreciate the choking dangers of marker caps. A teacher or daycare worker who puts out ink makers for use by toddlers or young children must constantly and diligently observe the toddlers to prevent them from placing marker caps into their mouths, causing them to potentially choke and suffocate. A typical, insufficient, technique for handling the choking risk associated with marker pens is for parents, teachers, or caretakers to place markers pens in a box or bulk container without their caps attached. Of course, this technique is extremely inefficient and waste makers because the markers quickly dry out and must be discarded. Furthermore, because the markers are not properly organized, many color markers are lost and must be replaced, resulting in unnecessary costs and frustration.

Clearly, an improved system and device is needed to better organize colored marker pens and also eliminate the cap choking hazard associated with use of marker pens by small children.

OBJECTS AND SUMMARY OF THE INVENTION

In view of the foregoing, an object of the present invention is to provide a marker pen holder that eliminates a need for marker caps;

Another object of the present invention is to provide a marker pen holder that is easy for a small child to use by having self-guiding receptacles for storing marker pens;

A further object of the present invention is to eliminate the choking hazard associated with loose pen caps around small children;

An additional object of the present invention is to maximize the lifespan and efficiency of marker pens by eliminating the problem of missing marker caps and resulting dried up markers;

Another object of the present invention is to provide a marker pen holder that stores marker pens in a well-organized configuration for the user; and A further object of the present invention is to provide a marker pen holder that stores pens securely in order to prevent pens from easily becoming dislodged and spill should the box overturn.

In accordance with the present invention, a marker pen storage system is provided comprising a housing having a plurality of receptacles for receiving marker pens, each receptacle formed to include an upper and lower cavity, the upper cavity located at the opening of the receptacle and formed to include a first upper inclined section and a first lower inclined section, wherein the first upper inclined section has a greater incline than the first lower inclined section, said lower cavity sized to receive a writing end of a marker pen, receptacle openings are formed immediately adjacent so as to create guidance walls between receptacles, and prevent a flat upper surface between adjacent receptacles, and a receptacle snap ring formed between the upper and lower cavities, wherein a relatively airtight seal is formed around a writing end of a marking pen when completely inserted into the lower cavity so as to prevent circulation of air to the writing end of the marker pen, and the receptacle snap ring produces a snap feel and sound when a marker pen is completely inserted into the lower cavity.

Additional features and advantages of the present invention will become apparent as the invention is more fully described in the following description, from the drawings, and from the claims. The description is purely illustrative and non-limiting.

DETAILED DESCRIPTION OF THE PREFERRED EMBODIMENTS

Figure 1:
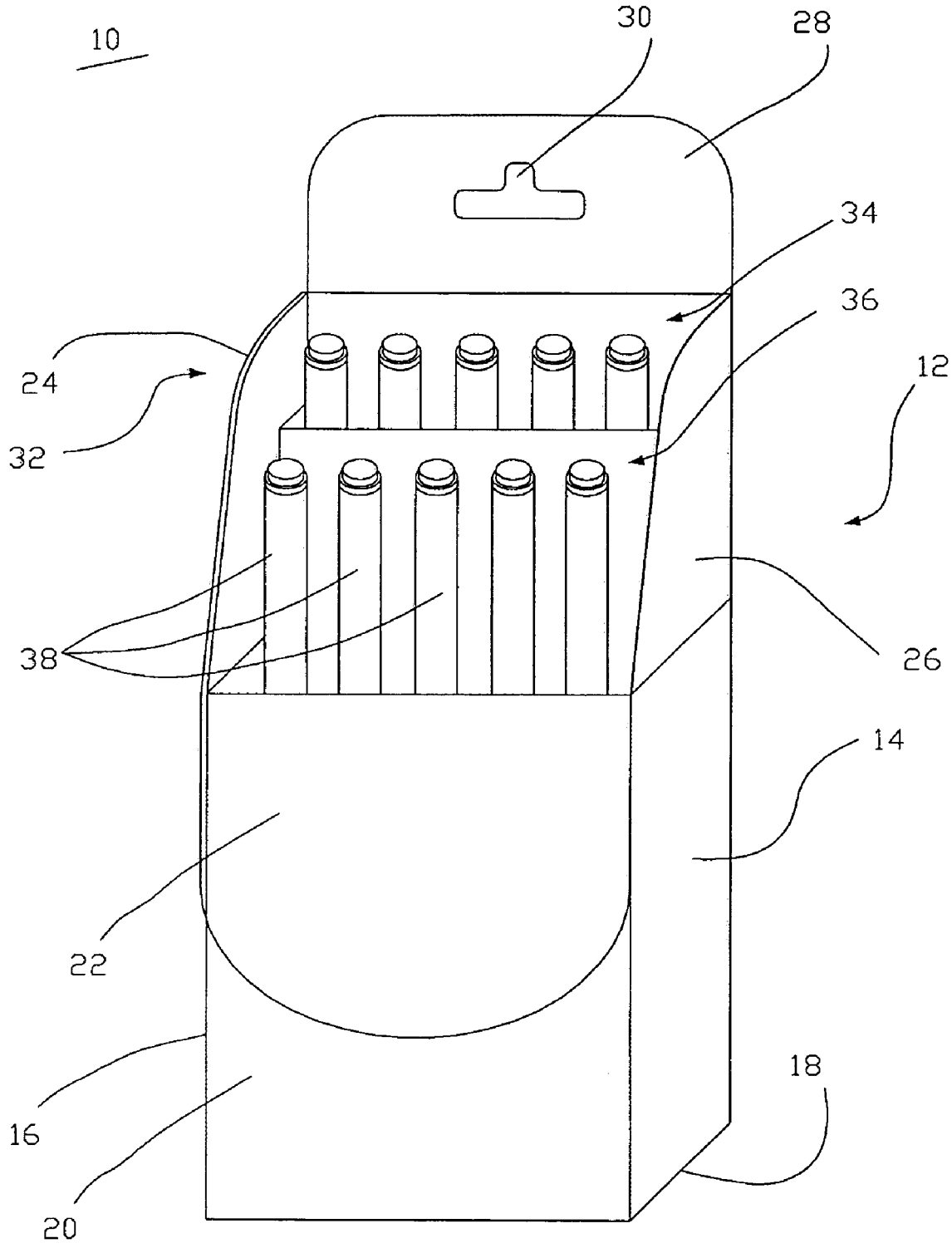
FIG. 1 is a marker pen box, including two rows of marker pens, configured in accordance with the present invention.

Referring to the drawings, FIG. 1 illustrates a marker pen storage system 10 configured in accordance with the present invention. The marker pen storage system 10 includes a box or container 12 having sides 14 and 16, a bottom 18, and a front 20. The marker pen storage system 10 further includes a flexible lid 22, preferable clear, and upper side walls 24 and 26. The box 12 has a back wall 28, which includes a hanging hole 30. The top 32 of the box or container 12 includes two rows 34 and 36 of receptacles (FIG. 2) for storing ink marker pens 38. The marker pens 38 typically include felt tips on the writing ends of the marker pens 38.

Figure 2:
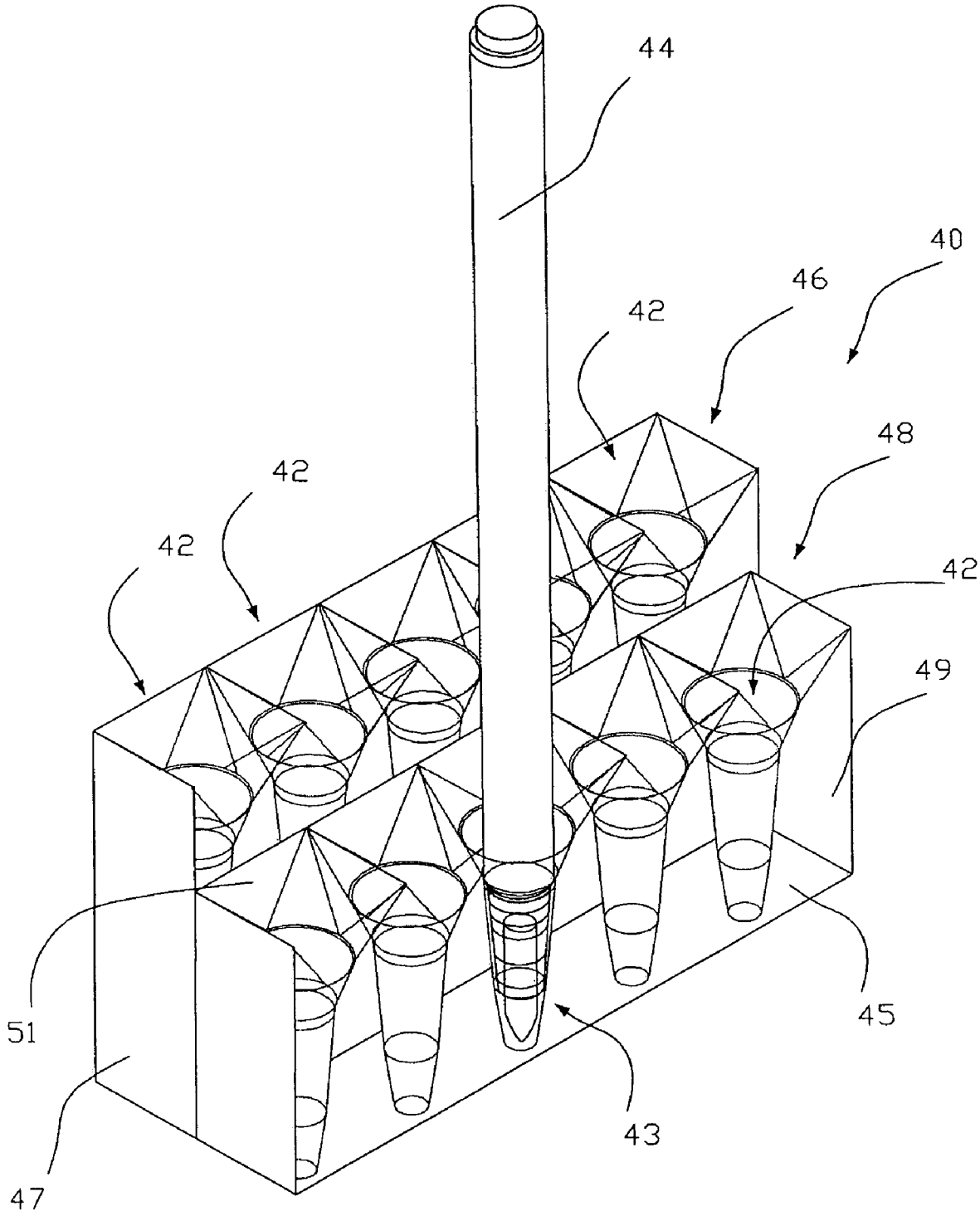
FIG. 2 is a perspective, cross-sectional, view of a marker pen holder system configured in accordance with the present invention.

In accordance with the present invention, FIG. 2 illustrates a housing 40 having receptacles 42 sized for receiving the writing end 43 of a drawing or marker pen 44. FIG. 2 shows a marker pen 44 fully inserted into a receptacle 42. In accordance with the present invention, receptacles 42 are sized to receive and store the writing end 43 of a marker pen 44 in a relatively airtight seal, without using marker pen caps. The housing 40 is preferably formed out of out of a single piece of molded plastic to include the two rows 46 and 48 of receptacles 42. In the illustrated embodiment, the each row 46 and 48 includes five receptacles 42. The housing 40 is to be contained within the box 12 (FIG. 1). The housing 40 a bottom platform 45, sides walls 47 and 49, and a dividing wall 51 between rows 46 and 48 of receptacles 42.

The receptacles 42 are integrated into a one piece plastic mold that is placed into the box 12 (FIG. 1). As will be described below, the receptacles 42 prevent stored maker pens from falling out while stored, prevent ink dry out, self-guide a pen marker while being put back into the storage box, and eliminate the need for conventional marker caps which are a choking hazard for small children.

Figure 3:
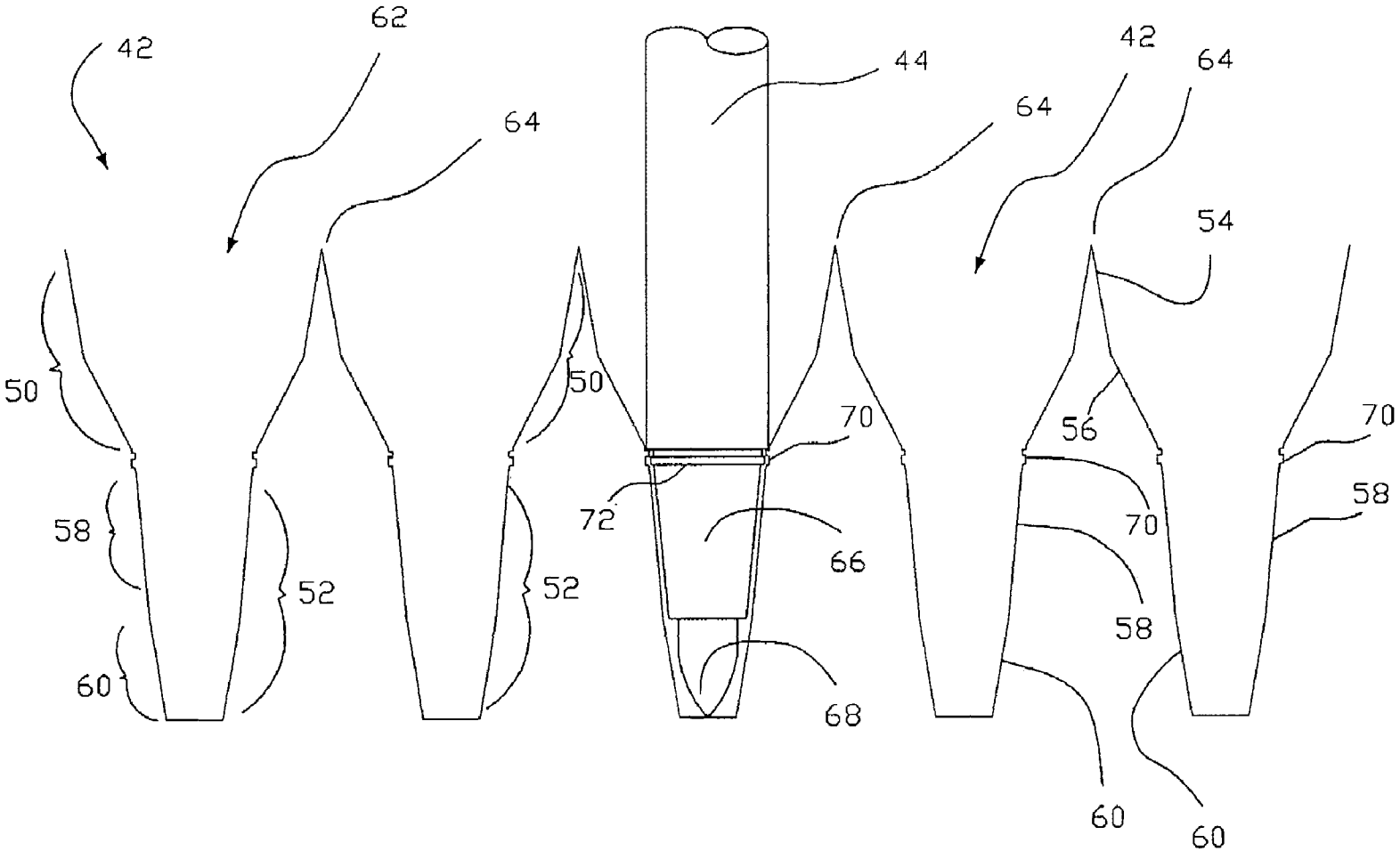
FIG. 3 is a cross-sectional view of receptacles for holding marker pens configured in accordance with the present invention.

FIG. 3 shows a more detailed, cross-sectional view of receptacles 42 configured in accordance with the present invention. Each receptacle 42 includes an upper cavity 50 and a lower cavity 52. The upper cavity 50 is formed to include a first upper inclined section 54 and a first lower inclined section 56. The lower cavity 52 is formed to include a second upper funnel 58 and a second lower funnel 60. Openings 62 on the top of each receptacle 42 are immediately adjacent to one another, and the top of each receptacle is separated by a thin guidance wall 64.

The guidance walls 64 are formed to have very steep walls relative to the receptacles 42, and thereby prevent the formation of any flat surface area on the top surface of the housing 10 near the openings of the receptacles 42. This configuration of guidance walls 64 enables a user to easily insert a marker pen into the appropriate receptacle 42 without a direct line of sight or striking a flat surface perpendicular to the angle of insertion of a marker pen. This configuration enables young children to easily insert marker pens into the receptacle without a direct line of sight to the receptacle 42. The guidance wall 64 provides a significant improvement over the prior art by enabling young child, who generally lack the dexterity in their fingers, to be able to put away their own markers without the assistance of an adult. As a result, a supervising adult does not need take time helping young children put away their markers, and the supervising adult can direct their attention to other matters.

In a preferred embodiment, the upper inclined section 54 of each receptacle 42 has a greater incline that the first lower inclined section 56 of the upper cavity 50. As discussed above, this configuration enables a user to easily locate and insert a marker pen into the proper location of the receptacle 42 without specifically seeing the opening 62.

The second upper funnel 58 has a greater incline than the second lower funnel 60 of the lower cavity 52. This configuration enables a writing end 66 and felt tip 68 of a marker pen 44 to be properly located within the lower cavity 52 of the receptacle 42.

In accordance with a further aspect of the present invention, a receptacle snap ring 70 is formed into the receptacle 42 between the upper cavity 50 and the lower cavity 52. The receptacle snap ring 70 preferably is a circular indention in the receptacle 42 sized for receiving a corresponding marker pen snap ring 72 on the writing end of a marker pen 44. When the marker pen is completely inserted into the receptacle 42, the user will feel and hear a "snap" as the marker pen snap ring 72 is inserted to the correspondingly sized receptacle snap ring 70 to form a relatively air tight seal. This snap feature allows a user, such as a small child, to be clearly alerted as to when a marker pen is completely inserted into the receptacle 42. Furthermore, the snap feature also functions to form a relatively air tight seal within the lower cavity 52 to prevent any air circulation to the felt tip 68. Of course, in other embodiments the receptacle snap ring 70 may be formed as raised or extending outward from the surface of the receptacle 42 to mate with a corresponding marker pen snap ring that is formed to be a circular indention proximate the writing end 66 of the marker pen 44.

Figure 4:
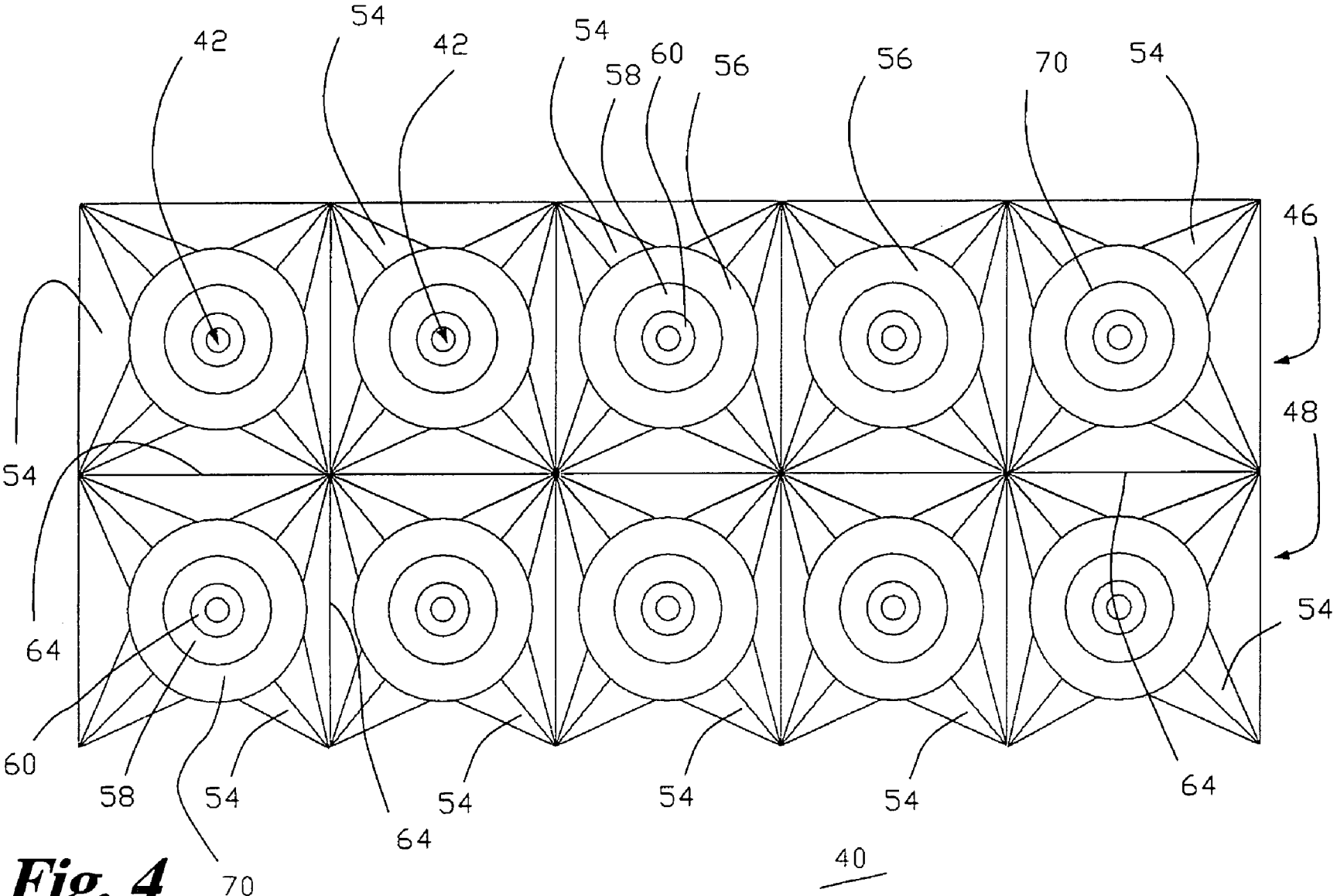
FIG. 4 is a top view of receptacles for holding marker pens configured in accordance with the present invention.

FIG. 4 shows the top of the marker pen housing 40 configured in accordance with the present invention as previously shown in FIGS. 2 and 3. FIG. 4 shows two rows 46 and 48 of receptacles 42 for receiving the writing ends of marker pens. Shown are receptacles 42, each having a first upper inclined section 54 and a first lower inclined section 56. A receptacle snap ring 70 also is illustrated in each receptacle 42. A second upper funnel 58 and a second lower funnel 60 of the lower cavity 52 are further illustrated in each receptacle 42. The guidance walls 64 in the present invention can be used in multiple rows and shapes in the housing 40 for multiple marker pens.

Figure 5A:
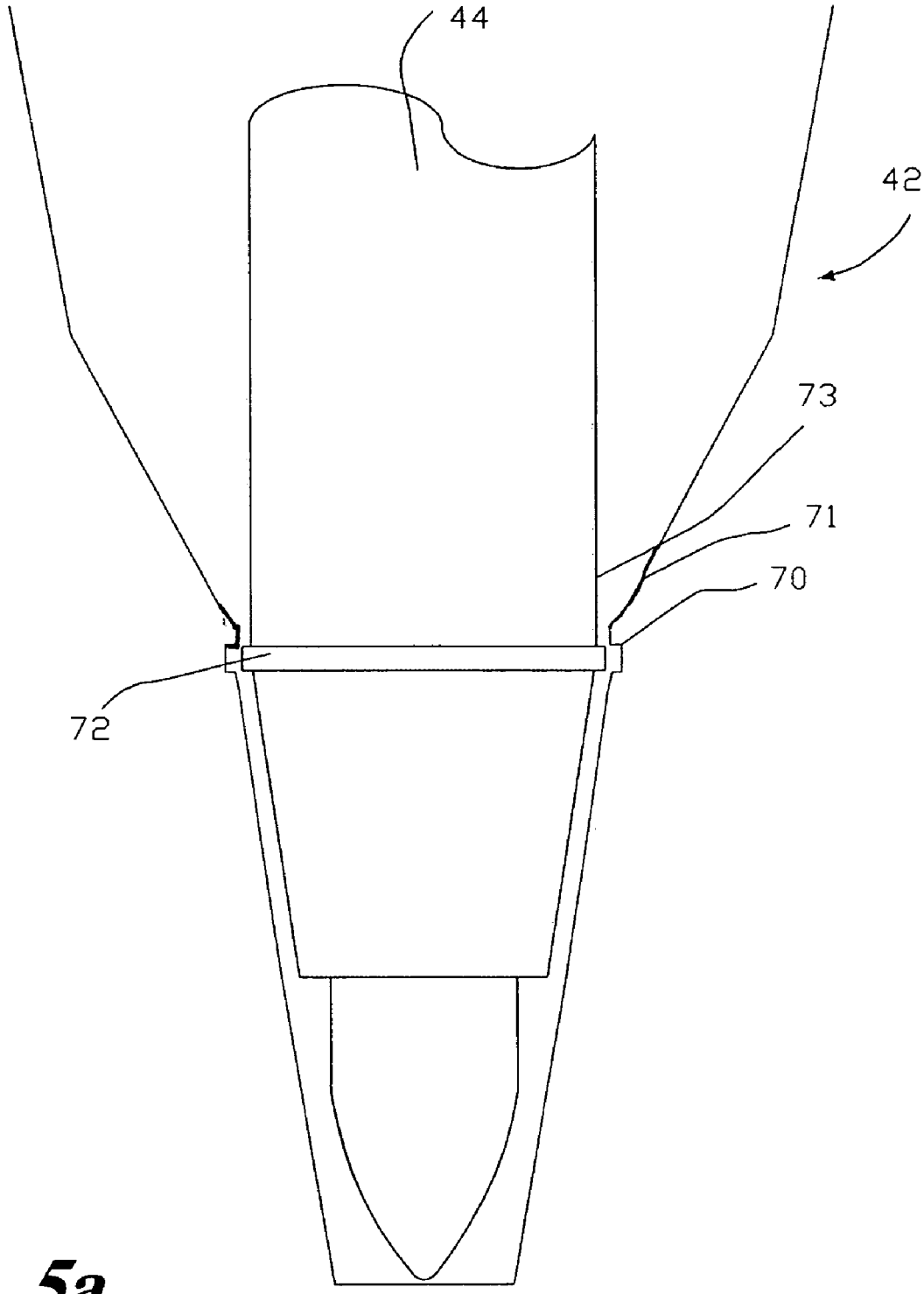
FIG. 5*a* is a cross-sectional view of a preferred embodiment of an indented receptacle snap ring and a raised marker snap ring configured in accordance with the present invention.
Figure 5B:
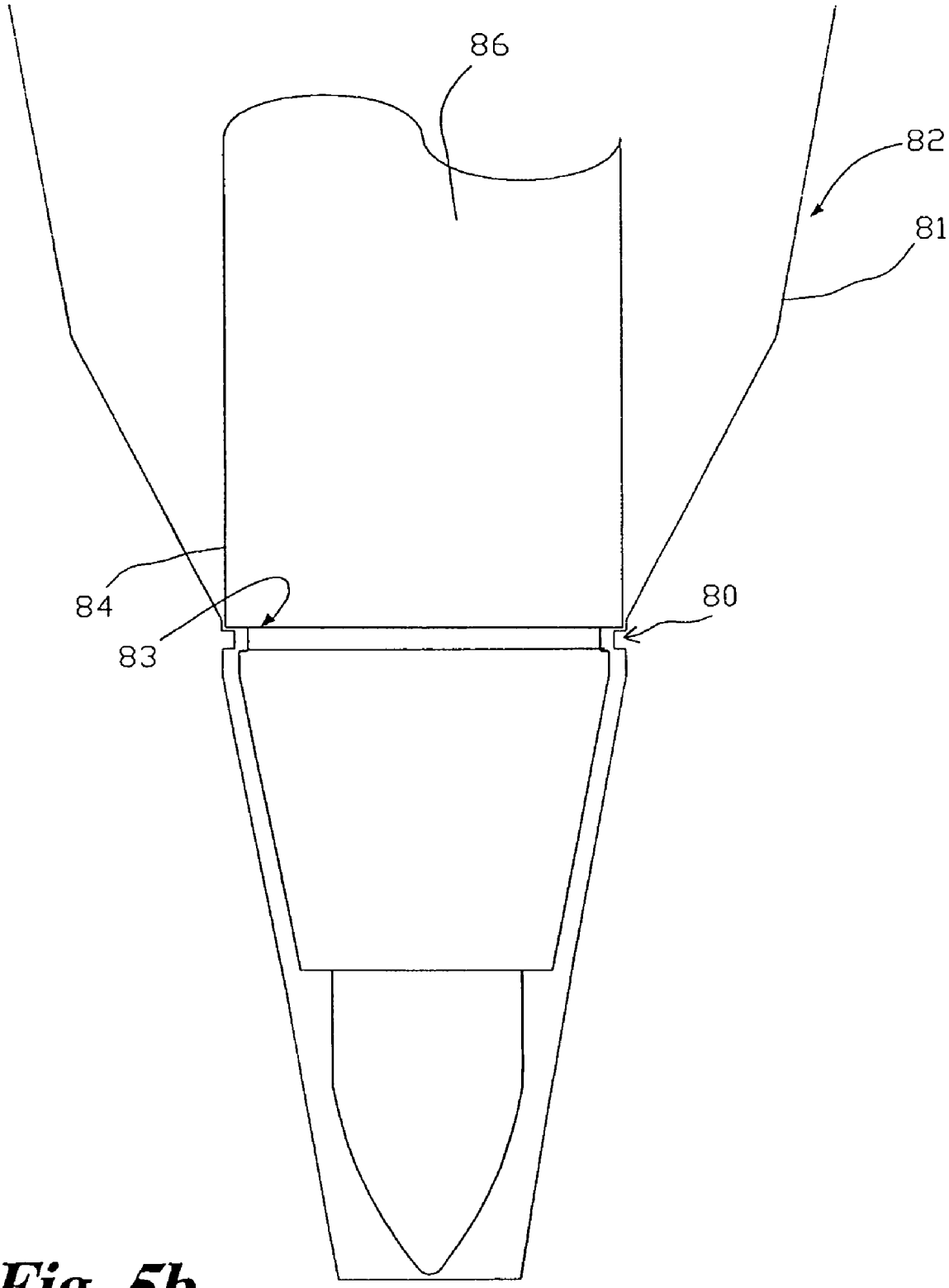
FIG. 5*b* is a cross-section view of an alternative embodiment comprising a raised receptacle snap ring and an indented marker pen snap ring configured in accordance with the present invention.

FIGS. 5*a* and 5*b* illustrate different embodiments for the receptacle snap ring and the marker pen snap ring. FIG. 5*a* illustrates the preferred embodiment shown in FIGS. 2 and 3, wherein the receptacle snap ring 70 is indented below the surface 71 of the receptacle 42, and the marker pen snap ring is a raised ring above the outer surface 73 of the pen 44. FIG. 5*b* is an alternative embodiment of the receptacle snap ring and the marker pen snap ring, wherein the receptacle snap ring 80 in a raised ring formed above the inner surface 81 of the receptacle 82, and the marker pen snap ring 83 is an indented ring below the outer surface 84 of a marker pen 86.

This design of the marker pen storage system maintains consistency with which manufactures produce products such as crayons and markers for the retail environment, allowing easy integration into their current boxed products and point of sale positions. The present invention is very simple from a manufacturing perspective, requiring a low cost single injection mold which is glued into a box or other container. Moreover, small children often lack the dexterity to precisely place a cap back onto a marker properly or fully. This issue typically reduces a parent's or teacher's desire to offer markers to young children as the caps are often mixed up, lost and left off of the marker, which results in a waste of product and money. The present invention seeks to address the later issues. Consumers will have a renewed positive view of using one of the world's most popular drawing apparatus's, a felt tip marker.

It is to be understood that the foregoing description is merely a disclosure of particular embodiments and is no way intended to limit the scope of the invention. Several possible alterations and modifications will be apparent to those skilled in the art.

I claim as my invention:

1. A marker pen holder, comprising:

a housing having a plurality of receptacles, each receptacle having an opening for receiving marker pens;

each receptacle formed to include an upper and lower cavity, said lower cavity sized to receive a writing end of a marker pen;

said receptacle openings of the housing are formed immediately adjacent so as to create guidance walls between each receptacle, thereby preventing formation of a flat upper surface between adjacent receptacles; and a receptacle snap ring formed between the upper and lower cavities, wherein a relatively airtight seal is formed around a writing end of a marking pen completely inserted into the lower cavity so as to prevent circulation of air to the writing end of the inserted marking pen, and the receptacle snap ring produces a snap feel and sound when a marker pen is completely inserted into the lower cavity.

2. The marker pen holder of claim 1, wherein the upper cavity is located at the opening of each receptacle and formed to include a first upper inclined section and a first lower inclined section, wherein the first upper inclined section has a greater incline than the first lower inclined section.

3. The maker pen holder of claim 1, further comprising a box container surrounding and supporting at least a portion of the housing.

4. The marker pen holder of claim 3, wherein the box container includes a flexible lid for covering the receptacles and any stored marker pens.

5. The marker pen holder of claim 3, wherein the box container is constructed from cardboard.

6. The marker pen holder of claim 3, wherein the box container is constructed of plastic.

7. The marker pen holder of claim 1, wherein the housing is constructed of plastic.

8. The marker pen holder of claim 1, wherein the housing is formed into a unitary element.

9. The marker pen holder of claim 1, further comprising:

a marker pen having a marker pen snap ring.

10. The marker pen holder of claim 9, wherein the receptacle snap ring is sized to receive the marker pen snap ring and form a relatively air tight seal.

11. The marker pen holder of claim 9, wherein the marker pen snap ring is raised.

12. The marker pen holder of claim 9, wherein the marker pen snap ring is indented.

13. The marker pen holder of claim 1, wherein the receptacle snap ring is indented.

14. The marker pen holder of claim 1, wherein the receptacle snap ring is raised.

15. The marker pen holder of claim 1, wherein the housing is formed to include two rows of receptacles.

16. A marker pen holder, comprising:

a box container;

a housing located within the box container having a plurality of receptacles, each receptacle having an opening for receiving marker pens;

each receptacle formed to include an upper and lower cavity, said lower cavity sized to receive a writing end of a marker pen;

said receptacle openings of the housing are formed immediately adjacent so as to create guidance walls between each receptacle, thereby preventing formation of a flat upper surface between adjacent receptacles; and a receptacle snap ring formed between the upper and lower cavities, wherein a relatively airtight seal is formed around a writing end a marking pen completely inserted into the lower cavity so as to prevent circulation of air to the writing end of the inserted marking pen, and the receptacle snap ring produces a snap feel and sound when a marker pen is completely inserted into the lower cavity.

17. The marker pen holder of claim 16, wherein the housing includes side walls.

18. The marker pen holder of claim 16, wherein the housing includes a back wall.

19. The marker pen holder of claim 16, wherein the upper cavity includes a first upper inclined section and a first lower inclined section, wherein the first upper inclined section has a greater incline than the first lower inclined section.

20. The marker pen holder of claim 16, wherein the lower cavity is formed to include a second upper funnel and a second lower funnel.

* * * * *